US009388511B2

(12) United States Patent
Gerking

(10) Patent No.: US 9,388,511 B2
(45) Date of Patent: Jul. 12, 2016

(54) SPINNERET FOR SPINNING THREADS AND SPINNING DEVICE FOR SPINNING THREADS

(76) Inventor: Luder Gerking, Berlin (DE)

( * ) Notice: Subject to any disclaimer, the term of this patent is extended or adjusted under 35 U.S.C. 154(b) by 757 days.

(21) Appl. No.: 13/695,633

(22) PCT Filed: May 4, 2011

(86) PCT No.: PCT/EP2011/002382

§ 371 (c)(1),
(2), (4) Date: Jan. 11, 2013

(87) PCT Pub. No.: WO2011/138056

PCT Pub. Date: Nov. 10, 2011

(65) Prior Publication Data

US 2013/0217290 A1 Aug. 22, 2013

(30) Foreign Application Priority Data

May 4, 2010 (DE) ..... 10 2010 019 910

(51) Int. Cl.
*D01D 5/14* (2006.01)
*D01D 4/02* (2006.01)
*D04H 3/00* (2012.01)

(52) U.S. Cl.
CPC ..... *D01D 5/14* (2013.01); *D01D 4/025* (2013.01); *D01D 4/027* (2013.01); *D04H 3/00* (2013.01); *Y10T 442/681* (2015.04)

(58) Field of Classification Search
CPC ..... D01D 4/02; D01D 4/025; D01D 4/027; D01D 5/14
See application file for complete search history.

(56) References Cited

U.S. PATENT DOCUMENTS 1,859,992 A * 5/1932 Seil ..... B22F 9/082 159/3
3,824,050 A * 7/1974 Balk ..... D01D 1/06 425/382.2

(Continued)

FOREIGN PATENT DOCUMENTS

DE 196 26 051 2/1997
JP 2009 275339 11/2009
WO WO 95/00684 1/1995

(Continued)

OTHER PUBLICATIONS

Gerking L et al.: "Nanoval splitspinning-from coarse to nano", Chemical Fibers International, IBP Press, Frankfurt AM Main, DE, vol. 58, No. Year Book, Oct. 1, 2008, pp. 80-81, XP001516709, ISSN: 0340-3343.

*Primary Examiner* — Yogendra Gupta
*Assistant Examiner* — Joseph Leyson
(74) *Attorney, Agent, or Firm* — Altera Law Group, LLC

(57) ABSTRACT

The invention relates to a spinneret for spinning threads from a spinning mass—in the form of a melt or solution of natural or synthetic origin—comprising a rotationally symmetrical spinneret. The rotationally symmetrical spinneret inner part is surrounded at least partially by a rotationally symmetrical outer part, wherein in the longitudinal direction between the spinneret inner part and outer part an insulating chamber is formed, in which a gas, preferably air, is received in order to form an insulating gas layer. The invention further relates to a spinning device for spinning threads from a spinning mass, comprising a spinneret part and a gas nozzle part arranged at a distance from the spinneret part. A plurality of spinnerets according to the invention are inserted in the spinneret part and project from the spinneret part, facing the gas nozzle part, and the gas nozzle part comprises a plurality of gas nozzles associated with the spinnerets. The gas nozzles are designed as acceleration nozzles for a gas flow that is conducted through the respective gas nozzle and encompasses the monofilaments. Said spinnerets are used in a method for producing spunbonded materials or yarns from polymers of natural or synthetic origin, in order to build up said materials or yarns from extremely fine threads having an average thread diameter of less than 1 μm. The threads from the individual spinnerets can also be collected using conventional winding mechanisms to form yarns on bobbins.

14 Claims, 3 Drawing Sheets

(56) References Cited

U.S. PATENT DOCUMENTS

| | | | | |
|---|---|---|---|---|
| 3,888,610 | A * | 6/1975 | Brackmann | A24D 3/0237 425/464 |
| 4,168,138 | A | 9/1979 | McNally | |
| 4,526,733 | A | 7/1985 | Lau | |
| 5,165,940 | A * | 11/1992 | Windley | D01D 5/22 264/12 |
| 2004/0201127 | A1 * | 10/2004 | James | D01D 4/025 264/211.11 |
| 2005/0136781 | A1 * | 6/2005 | Lassig | D01D 4/025 442/415 |
| 2009/0221206 | A1 * | 9/2009 | Gerking | D01D 4/025 442/401 |

FOREIGN PATENT DOCUMENTS

| | | |
|---|---|---|
| WO | WO 2004/092458 | 10/2004 |
| WO | WO 2006/037371 | 4/2006 |
| WO | WO 2007/101459 | 9/2007 |

* cited by examiner

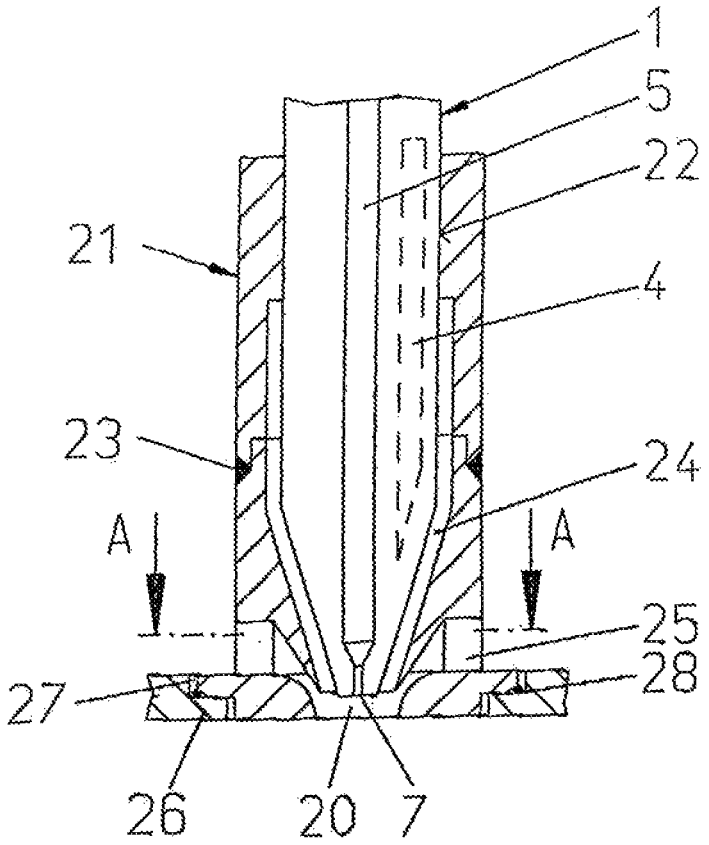
Fig. 7
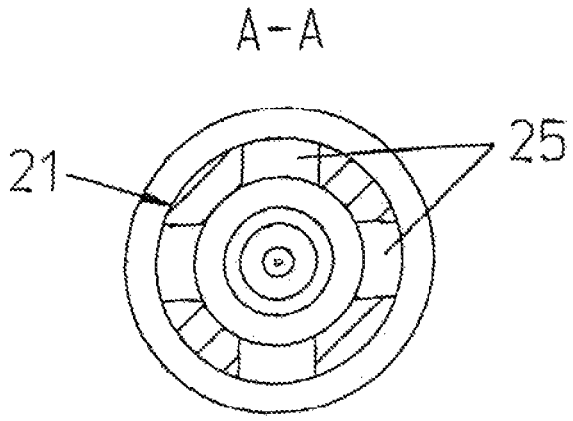

SPINNERET FOR SPINNING THREADS AND SPINNING DEVICE FOR SPINNING THREADS

The invention relates to a spinneret for spinning threads from a spinning mass, according to the preamble of the independent device claim, a spinning device which has a large number of spinnerets and a method for spinning threads, according to the preamble of the independent method claim.

In general, spinning threads takes place by longitudinal drawing of a thread-forming mass from a spinneret, the longitudinal drawing being implemented mechanically by forces acting on the threads, by means of devices such as winders, or aerodynamically by accompanying gas flows, mostly airflows, as in the spunbonded process, to which also meltblowing belongs. Out of a spinneret opening, a thread of a smaller diameter than that of the spinneret opening, boring or hole is thereby produced.

The procedure is different with split spinning in which a plurality of threads are produced from one spinneret opening by splicing or splitting the liquid, thread-forming flow of spinning mass, whether it be melts or solutions, as described in EP 1 192 301 or EP 1 358 369. This process, frequently also called Nanoval process in the meantime, is distinguished by more throughput per spinneret boring being achieved, in particular in the case of finer threads, measured for example in g/min, with simple technical apparatus since 20, 50 up to a few hundred threads are readily able to be produced per hole. The threads are essentially endless and have a specific size distribution of the thread diameters according to the type of operation.

The airflows which cause splitting of the emerging spinning mass according to the "Nanoval effect" move close to the spinneret openings. These are situated in conically ending nipple-shaped spinnerets which project from a spinneret plate, as described in EP 1 902 164 A1, and cool these since the air in general has a lower temperature than that of the spinning mass which flows in the spinnerets, also termed spinning nipples here. This is disadvantageous in particular with small throughputs for producing finer threads by splitting into as many fine threads as possible. This disadvantage can be eliminated at least partially by heating the air reaching the spinnerets, which however entails higher energy expenditure. The individual spinnerets or nipples can also be heated, the expenditure in technical apparatus also being increased here.

Hence the object underlying the invention is to produce a spinneret for use of the known split-spinning process and a device and a method for spinning threads with which it is possible to achieve finer threads, relative to the state of the art, with a higher throughput and simple construction of the spinneret at the same time.

This object is achieved according to the invention by a spinneret having the features of claim 1, by a device using a plurality of such spinnerets and a method having the features of claim 12.

Advantageous developments and improvements are possible by means of the measures indicated in the sub-claims.

As a result of the fact that the rotationally symmetrical spinneret inner part with supply channel of the spinneret is surrounded at least partially by a rotationally symmetrical outer part and at least one insulating chamber is configured between the spinneret inner part and outer part in the longitudinal direction of the spinneret, in which insulating chamber a gas, preferably air, is received in order to form an insulating gas layer, the heat loss of the spinning mass which flows in the supply channel in the air which flows at least partially around the spinning nipple is less. If the at least one insulating chamber is designed such that it is sealed in a gas-tight manner to the exterior, a vacuum instead of gas can also be formed therein. This means that the spinning mass in the supply channel retains a higher temperature for longer and arrives at the exit boring with a higher temperature, which has a positive effect on the viscosity of the spinning mass which flows in the exit boring, i.e. the viscosity is less than in the case of a spinneret of the same dimensions without an insulating chamber. Lower viscosities lead advantageously to finer threads and to a higher throughput. As a result of the fact that the spinning mass in the insulated supply channel retains its temperature for longer and arrives hotter at the at least one exit boring, the exit boring can be provided with a smaller diameter which basically makes possible finer threads. The spinneret inner part and the outer part can be configured respectively at least partially rotationally symmetrically, also other shapes being conceivable however. Polymers and solutions of a synthetic and natural origin can be used as spinning mass. Relative to spinnerets which are provided with heating elements, the advantage of less constructional complexity results. According to the invention, fine threads of an average thread diameter below 1 μm can hence be produced.

In a particularly advantageous embodiment, a plurality of exit borings is disposed in the spinneret tip part. The exit borings are connected to the supply channel and out of which respectively one monofilament can be spun out. By providing a plurality of exit borings, the throughput of spinning mass can be increased, which in turn leads to an increase in the temperature at the transition point between supply boring and exit borings. Consequently, a thinner monofilament which splits into finer threads can be spun out per exit boring. The exit borings or openings can be of the same shape and cross-section but need not be, rather they can have different shapes and cross-sections.

In an advantageous embodiment, the spinneret tip part has directional elements incorporated in the circumferential surface thereof which serve for guiding gas to flow around the monofilaments. They can thereby be configured as flattened surface elements which are disposed over the circumference and/or as groove-, channel- or trough-shaped recesses which taper towards the tip. As a result, the airflows can be conducted more uniformly and essentially in a laminar manner to all the monofilaments which are spun out of the spinneret.

In a preferred embodiment, the exit borings are directed to the exterior at an acute angle towards the centre line of the spinning nipple, as a result of which it is avoided that the liquid monofilaments which are spun out of the exit borings do not converge. However the exit borings can also extend outwards in a curve. The term "exit boring" does not mean that it must always have a round cross-section. It can also have for example an oval or polygonal cross-section, such as rectangular or square.

The insulating chamber of the spinneret can be produced in a simple manner as a result of the fact that the rotationally symmetrical spinneret inner part has a projection or shoulder with which the rotationally symmetrical, sleeve-shaped outer part can come into engagement at one end whilst forming the likewise rotationally symmetrical, oblong insulating chamber if the spinneret can be inserted by its thread provided on the outer part into a mounting, e.g. a spinneret plate.

Preferably, directional elements can be provided on the spinneret tip, which directional elements are configured such that the cross-section of the spinneret tip part has a polygonal, cruciate, cloverleaf-shaped or star-shaped configuration.

In the case of the spinning device according to the invention, a plurality of spinnerets according to the invention are inserted in a spinneret part, a gas nozzle part being disposed at a spacing relative to the spinneret part and having a plurality of gas nozzles assigned to the spinnerets, which gas nozzles are configured as acceleration nozzles of a gas flow which is conducted through the respective gas nozzle and surrounds the monofilaments. With a spinning device of this type, a large number of thin threads which are produced by splitting a large number of monofilaments can be produced, both the number of threads and the fineness of the threads being able to be increased by increasing the exit borings of the spinnerets.

The gas nozzles are preferably rotationally symmetrical and assigned respectively to one spinneret, as a result of which the gas flow can flow uniformly around the spun-out monofilaments, however also slot-shaped gas nozzles or Laval nozzles can be provided, in particular when the exit borings are disposed in a row in the spinneret tip part.

In a preferred embodiment, the spinneret part has a plurality of rows of spinnerets and, for particular preference, the spinnerets of one row are offset relative to the spinnerets of an adjacent row. Consequently, spunbonded fabrics of greater uniformity can be produced.

A further advantageous embodiment of spinnerets which are insulated against heat losses in the interior thereof and the positioning thereof relative to the acceleration nozzles situated behind in the flow direction e.g. in the form of Laval nozzles, is the rigid connection and hence defined positioning of the spinneret centre relative to the acceleration nozzle centre. This has the advantage that the emerging liquid spinning material jets are caught uniformly at the circumference by the gas-, generally air jets, since in general the otherwise produced irregularities over the thread cross-section are not desired. In this way the different expansion between the warmer spinneret part and the following gas nozzle part can be equalized even over fairly large spinning widths in a spinning device, also often termed spinning beam, so that the centres of the spinning lines of both parts which produce the "Nanoval effect" are always aligned: in the case of a plurality of outflow openings in the spinneret, the centre thereof in the spinneret tip is considered as the beginning of the spinning line, if special effects, such as a twist for the yarn formation in the acceleration nozzle, are not intended to be produced, which is generally avoided in the case of nonwovens.

According to the invention, a monofilament is spun out of at least one spinneret in the case of the method for spinning threads from a spinning mass by splitting, which monofilament is accelerated by a surrounding gas flow until splitting, the spinning mass for spinning out being conducted via a supply channel which is insulated against heat losses by a gas cushion surrounding it. The advantages relative to the method according to the state of the art without insulation correspond to those which were described in connection with the spinneret.

In a preferred embodiment of the method, the spinning mass which is conveyed in the supply channel is divided into a plurality of partial flows which are separated from each other, are spun out respectively as monofilament and are split into a large number of essentially endless threads by means of the accelerated gas flow.

In order to produce particularly fine threads from synthetic and natural polymers, such as polypropylene, polyester and other thread-forming spinning materials, such as cellulose solutions or those made of PAN or aramids, the flowing spinning mass per exit opening must be reduced in order that the necessary deformation work on the liquid monofilament is increased. However this implies the danger of greater cooling, particularly in the exposed region of the spinnerets, which counteracts splitting or bursting into a higher number of individual threads. As a result of the fact that a plurality of exit borings is provided on the spinneret, i.e. the spinning mass in the spinneret tip is divided into a plurality of partial flows, the flowing spinning mass per exit boring can be reduced and nevertheless there is no danger that the spinning mass in the supply channel is cooled too greatly since the throughput therein is increased and hence the temperature at the exit borings is higher and the quantity of spinning mass in the supply channel no longer depends upon the size of the exit boring alone, but upon the number of exit borings and the size thereof.

BRIEF DESCRIPTION OF THE DRAWINGS

Embodiments of the invention are represented in the drawing and are explained in more detail in the subsequent description. There are shown FIG. 1 a section through a spinneret according to the invention, FIG. 2 a section through a part of the device according to the invention having a plurality of spinnerets according to the embodiment according to FIG. 1, FIG. 3 a partial section through a spinneret according to a further embodiment and a plan view on the spinneret tip from below, FIG. 4 a schematic simplified view on a spinneret according to a third embodiment of the invention, FIGS. 5*a*, 5*b* and 5*c* views of different embodiments of the spinneret tip part and spinnerets according to the invention, FIG. 6 a partial section on the lower spinneret region of a spinneret according to the invention having a slot-shaped Laval nozzle and FIG. 7 a partial section through a further embodiment of a spinning device according to FIG. 2, in which spinneret and acceleration nozzle are connected to each other.

Figure 1:
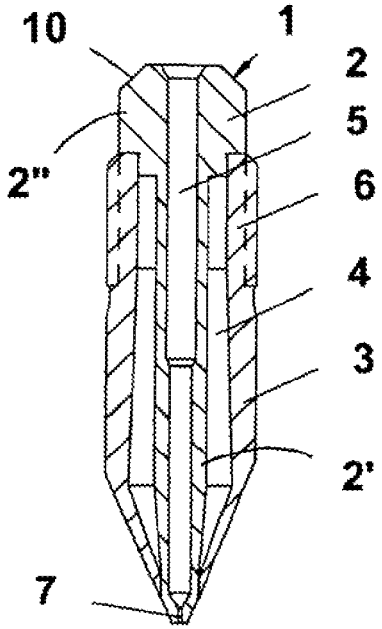
In FIG. 1, a spinneret 1 according to a first embodiment is represented. The spinneret comprises a rotationally symmetrical spinneret inner part 2 and a rotationally symmetrical outer part 3, the outer part 3 having a sleeve-like configuration and having an outer thread 6 at the one end and, at the other end, i.e. the spinneret tip region, being conical. The inner part 2 comprises a pin-like region 2' with a conical end which changes at the other end into a stepped projection 2" or shoulder with a larger diameter than the pin-like region 2'. The rotationally symmetrical inner part 2 is penetrated in the longitudinal direction, i.e. in the axial direction, by a supply channel 5 which is connected in the spinneret tip region to one or more exit borings 7. The rotationally symmetrical outer part 3 can be screwed by its outer thread together with the inner part into a mounting (is described further below), the stepped projection serving as limit stop. The dimensions of inner part 2 and outer part 3 are calculated thereby such that, between both, an oblong insulating chamber 4 which is configured as a cavity is formed and filled with gas, generally air. The outer part 3, i.e. the end of its cone, abuts in the spinneret tip region against the inner part 2 to form a seal, the cone of the outer part 3 continuing with the conical end of the pin-like region of the inner part 2 and both forming the spinneret tip region.

The supply channels 5 of each spinneret 1 are connected to corresponding supply channels 11 which are configured in the spinneret part 9 and a part 8 situated thereabove and which are connected to a distribution chamber, not shown, into which spinning mass is introduced. Below the spinneret part 9, at a spacing forming a space 13, a gas nozzle plate 15 is disposed, which gas nozzle plate has a large number of acceleration nozzles 14 which can be configured as Laval nozzles, i.e. with a tapering region and an abruptly or continuously widening region. The gas nozzle plate 15 is thereby disposed, relative to the spinnerets 1, such that the tips of the spinnerets 1 dip slightly into the acceleration nozzles 14 or lie somewhat above the acceleration nozzles 14. Preferably, a plurality of rows of spinnerets 1 is provided in the spinneret part 9, adjacent rows being able to be offset relative to each other. In order to produce a spunbonded fabric, preferably a plurality of rows of spinnerets 1 of such a spinneret arrangement are disposed transversely relative to the direction of travel of a collection belt or a collection drum corresponding to the desired web width.

The space 13 between spinneret part 9 and gas nozzle plate 15 serves for supplying a gas, preferably air, which flows through the acceleration nozzles 14 corresponding to the arrows 12. Respectively one monofilament 16 is spun out of the exit borings 7 of the spinnerets and, according to the Nanoval process, the air flows around these monofilaments 16 or the lower region of the spinnerets 1, according to the arrows 12 in the space 13, with increasing speed towards the acceleration nozzles 14 through which it leaves the space 13. The openings of the acceleration nozzles 14 are in general round but can also have a slot-shaped configuration. They are convergent in the flow direction and can be configured, in their cross-sections, in the form of a convergently-divergently extending Laval nozzle, also abrupt transitions being possible. The acceleration nozzles 14 correspond in their longitudinal axis to the longitudinal axis of the spinning nipples 1. As can be noted, the monofilament 16 splits into a large number of threads 17 as a result of the pressure ratios inside and outside the monofilament, which threads can be deposited, during the production of the web, on a collection belt or a collection drum or can be collected as yarns on bobbins with normal winding devices.

Particularly in the lower part of the spinning nipple 1 or of the spinning nipples, the cooling effect of the air increases with increasing air speed due to the flow which is directed for example rotationally symmetrically towards the opening of the acceleration nozzles 14. In an accelerating flow, the air should surround the liquid monofilament essentially parallel as soon as possible and be significantly greater than the thread speed. It follows therefrom at the same time that the cooling, in particular of the nipple tip, should be paid great attention, because, in the case of the method which is applied, the thread fineness is primarily dependent upon the temperature of the spinning mass and only thereafter upon the acting air speed which causes splitting due to the production of shear stresses on the liquid flow. The cooling is reduced by the air layers of the insulating chamber 4 which surround the supply channel 5 with the flowing fibre-forming spinning mass. Since the heat loss of the spinning mass to the exterior and hence the temperature difference between the upper region of the supply channel 5 and the exit boring is less, it arrives at a higher temperature at the exit borings 7 of the respective spinneret 1. Since the temperature is higher, the viscosity in the case of most spinning masses is lower and respectively more spinning mass can flow through the supply channels 5 and exit borings 7.

Figure 2:
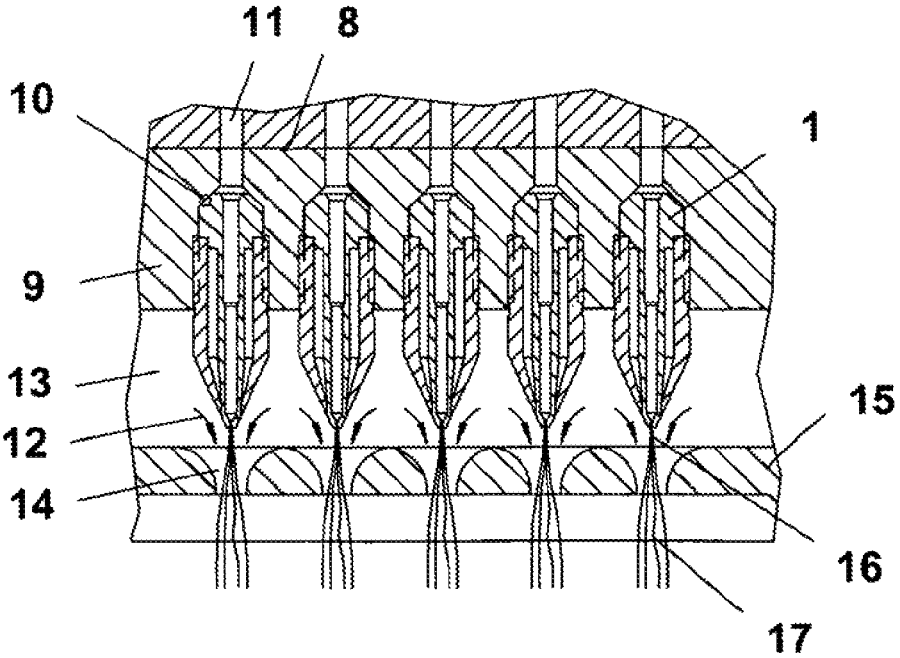
In FIG. 2, the device according to the invention is represented, in which a large number of per se insulated spinnerets 1 or spinning nipples, forming a spinneret arrangement, is inserted into a spinneret part 9 or a spinneret plate, the spinnerets 1 being screwed into the spinneret part 9 by means of the thread 6 on the outer part 3 and being sealed by the spinning nipples 1 via oblique or inclined surfaces 10 on the projection 2" of each spinneret 1 in the receiving borings of the spinneret part 9 for supplying spinning material since the oblique surfaces 10 are pressed against the spinneret part 9 when being screwed together.
Figure 3:
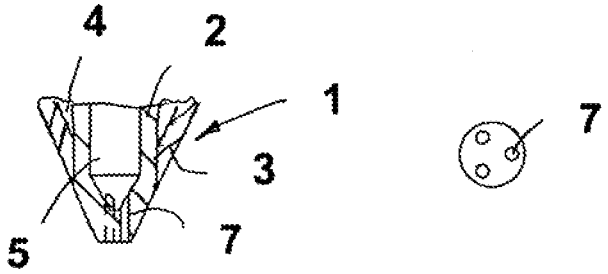

In FIG. 3, a further embodiment of the spinneret according to the invention which can likewise be used in a device according to FIG. 2 is represented. This spinneret 1 according to FIG. 3 differs from that according to FIG. 1 by the fact that three exit borings 7 are provided for spinning out three monofilaments and are connected to the supply channel 5. The arrangement of these exit borings 7 can be detected on the right in FIG. 3 in the plan view on the spinneret tip from below. The arrangement of three exit borings 7 is mentioned here merely by way of example, also more exit borings, also called capillaries, can be mentioned or even only two can be provided. By arranging a plurality of exit borings 7 in the spinneret tip, the throughput can be increased.

By way of example, the following dimensions can be indicated for the nipple tip, as have proved to be advantageous for threads around and below 1 μm diameter: d1=diameter of the supply channel=1.5 mm to 2 mm, d2=diameter of the capillary=0.2 mm to 0.6 mm. The length of the exit boring or of the capillary is thereby for example 1 mm to 2.4 mm. The length of the spinneret is of the order of magnitude of 30 mm. All these data are merely by way of example, other dimensions can be used as a function of the specifications.

Figure 4:
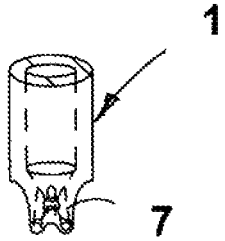

As represented in FIG. 4, the exit borings 7, in contrast to FIG. 3, in which they are disposed parallel to each other, can be directed to the exterior at an acute angle to the centre axis of the spinneret 1.

Consequently, the danger is avoided that the monofilaments spun out of the exit borings 7 and the multifilaments after splitting converge.

The outer surfaces of the spinneret tip between the borings 7 can be configured in the form of flat portions or groove-shaped recesses which taper towards the tip for better introduction of air with the aim of uniform encompassing of the emerging monofilaments. For this purpose, some "flesh" is removed from the round cross-section of the tip.

Figure 5:
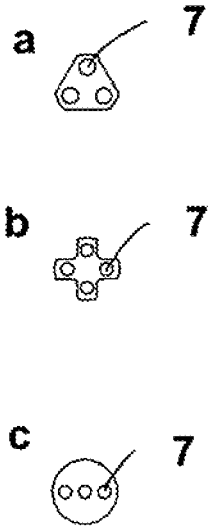

In FIG. 5, the view of the spinneret tip from below is represented in three different embodiments, FIG. 5*a* having an essentially triangular shape with flat portions, in FIG. 5*b* a cross with four exit borings is represented, the groove-shaped recess between the legs of the cross being able to be detected. FIG. 5*c* shows three exit borings 7 which are situated in a row one beside the other or one behind the other.

Figure 6:
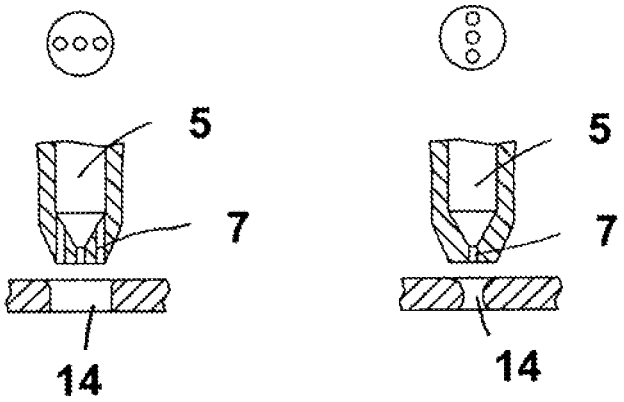

For this embodiment according to FIG. 5*c*, in FIG. 6 an assignment of the spinneret tip of one spinneret 1 to a slot-shaped Laval nozzle 14 is represented in two side views.

EXAMPLE

In an arrangement according to FIG. 2 with a plurality of spinnerets 1 in nipple form, a configuration according to FIG. 3 with three openings of diameter 0.25 mm was used. With a throughput of polypropylene of 1.5 g/min per opening or exit boring with a melt flow index MFI (Melt Flow Index, also termed MFR, Melt Flow Rate) of 28 and 1,200, measured in a device which is standardised according to ISO 1133 which indicates how many grams of a heated thermoplastic polymer are pressed within 10 min through a spinneret under the effect of a fixed force, here for polypropylene at 230° C. and 2.16 kg, average thread diameters were produced after splitting, measured from 20 individual threads in the microscope: 1 capillary of 0.25 mm diameter provided at 1.5 g/min and MFI 28 an average thread diameter of 1.1 μm with the smallest measured diameter of 0.8 μm, at MFI 1,200 an average thread diameter 0.95 μm, smallest 0.4 μm. In the case of three capillaries with 0.25 mm diameter, there resulted thread diameters of 0.8 μm at MFI 28 and 0.7 μm at MFI 1,200 with a throughput of 3×1.5 g/min, i.e. 4.5 g/min per spinneret.

In FIG. 7, a spinneret 1 in nipple form which can have an embodiment according to FIGS. 1 and 3 to 6 is represented, which spinneret is combined with an acceleration nozzle 20, e.g. Laval nozzle, corresponding to the acceleration nozzles 14 in FIG. 2 and FIG. 6. As in FIG. 1, the spinneret 1 is essentially rotationally symmetrical and has, in the middle thereof in the interior, the supply channel 5 for the spinning material which ends with the outflow opening or exit boring 7 of the capillary. In the middle below it, the acceleration- or Laval nozzle 20 is situated, which ends in the flow direction of the acceleration gas after a constriction to a narrowest cross-section, i.e. can widen abruptly or widen continuously. The Laval nozzle 20 is a component of a jacket 21 which engages around the spinneret 1 and can slide on the latter in a fit corresponding to the reference number 22. This serves for the purpose of the spacing between capillary exit and lower Laval nozzle surface being able to be changed during spinning out and cleaning (see also EP 1 902 164 A1). If this is dispensed with, the jacket 21 can be connected rigidly to the spinneret 1, e.g. via a thread. Furthermore, the jacket 21 can, for technical manufacturing reasons, consist of an upper and a lower part which are connected to each other shown with the reference number 23.

According to the aim of the present invention, a cavity 24 is also provided between the jacket 21 and the spinneret 1 for insulation by means of gas or air. Furthermore, insulating chambers 4, as shown in FIG. 1, can be provided in the spinning nipple. In the lower region of the jacket 21, gas openings 25 are incorporated above the Laval nozzle 20, e.g. at four points, as is shown in section A-A in FIG. 7. As shown in FIG. 7, the jacket 21 is coupled to the acceleration nozzle 20 via extending webs (not labeled) which delimit openings 25. The gas or the air can flow through these gas openings towards the acceleration nozzle and produce, in the spinning material monofilament, the Nanoval effect, i.e. splitting of the spinning material monofilament. In the case of a spinning device according to FIG. 2, the lower part of the jacket 21 lies on a plate 26 with openings for receiving the acceleration nozzles 20 provided in the lower part of the jacket 21. The plate 26 together with the Laval nozzles 20 forms the gas nozzle plate 15 according to FIG. 2, or a gas nozzle part which can be raised and lowered, the jacket 21 correspondingly being displaced on the spinneret 1. In order to avoid creep flows of the acceleration gas from the space 13, corresponding to FIG. 2, between spinneret part (9 in FIG. 2) and gas nozzle part 26, 20 through annular gaps 27 between acceleration nozzles 20 and the plate 26 receiving them, as a result of the higher pressure in the space 13, into the surroundings of the spinning device, respectively one gasket 28 which prevents the creep flow can be provided in the annular gap 27. The acceleration—or Laval nozzles 20 or the lower part of the jackets 21 can be moved respectively—horizontally in the drawing—in the annular gaps 27.

The invention claimed is:

1. Assembly of a spinneret and an acceleration nozzle for a spinning device for spinning threads from a spinning mass by splitting a monofilament which is spun from the spinneret, the spinneret having a spinneret inner part and an outer part which surrounds at least partially the spinneret inner part, the spinneret inner part, in the longitudinal direction thereof, having a channel for supplying spinning mass to a spinneret tip part having at least one exit boring, wherein the spinneret inner part is connected to the outer part so that at least one insulating chamber is configured between the spinneret inner part and outer part in the longitudinal direction, in which insulating chamber a gas is received in order to form an insulating gas layer or in which an insulating vacuum is provided and wherein the spinneret and the acceleration nozzle are connected to each other to form one unit and wherein the spinneret is connected to a surrounding jacket, the jacket being coupled to the acceleration nozzle via extending webs which delimit openings for a passage of a gas flow to the acceleration nozzle.

2. Assembly of a spinneret and an acceleration nozzle according to claim 1, wherein a hollow space is provided between a part of the jacket and the spinneret for insulation by means of gas.

3. Assembly of a spinneret and an acceleration nozzle according to claim 1, wherein a plurality of exit borings is disposed in the spinneret tip part, which are connected to the supply channel and out of which respectively one monofilament can be spun.

4. Assembly of a spinneret and an acceleration nozzle according to claim 1, wherein the spinneret has a tapering tip part and directional elements are incorporated in the circumferential surface of the tapering spinneret tip part for guiding gas which flows around the monofilaments.

5. Assembly of a spinneret and an acceleration nozzle according to claim 4, wherein the directional elements are configured as any one of the elements of flattened surface elements, groove-shaped recesses, channel-shaped recesses and trough-shaped recesses which taper towards the tip, the elements being disposed over a circumference of the spinneret tip part.

6. Assembly of a spinneret and an acceleration nozzle according to claim 3, wherein the longitudinal axes of the exit borings are inclined relative to the longitudinal axis of the supply channel in a downstream direction of the longitudinal axis of the supply channel.

7. Assembly of a spinneret and an acceleration nozzle according to claim 1, wherein the spinneret inner part has a rotationally symmetrical pin-like region to which a projection is attached, wherein the outer part, being formed as a rotationally symmetrical sleeve, surrounds the pin-like region and is supported on the projection, thereby forming the likewise rotationally symmetrical at least one insulating chamber.

8. Assembly of a spinneret and an acceleration nozzle according to claim 1, wherein the cross-section of the spinneret tip part has a polygonal, cruciate, cloverleaf-shaped or star-shaped configuration.

9. Assembly of a spinneret and an acceleration nozzle according to claim 1, wherein the ratio of the diameter of the supply channel to the diameter of the exit borings is between 2 and 12.

10. Assembly of a spinneret and an acceleration nozzle according to claim 1, wherein the spinneret and the acceleration nozzle are rigidly connected to each other such that the center of the spinneret is positioned to the center of the acceleration nozzle.

11. Spinning device for spinning threads from a spinning mass by splitting of monofilaments comprising a spinneret part and a gas nozzle part, said gas nozzle part being disposed at a spacing relative to the spinneret part, wherein a plurality of spinnerets are inserted in the spinneret part, whereby the spinnerets protrude out of the spinneret part, and are orientated towards the gas nozzle part, and are spinning monofilaments, wherein the gas nozzle part has a plurality of acceleration nozzles which are configured to accelerate a gas flow being guided through the respective acceleration nozzle and surrounding the monofilaments for splitting the monofilaments to threads wherein one spinneret and one corresponding acceleration nozzle form an assembly of a spinneret and an acceleration nozzle, respectively, and the spinneret and the acceleration nozzle are connected to each other to form one unit, the spinneret having a spinneret inner part and an outer part which surrounds at least partially the spinneret inner part so that at least one insulating chamber for receiving an insulating gas or an insulating vacuum is configured between the spinneret inner part and outer part in the longitudinal direction, the spinneret inner part, in the longitudinal direction thereof, having a channel for supplying spinning mass to a spinneret tip part having at least one exit boring, wherein each spinneret is connected to a surrounding jacket, the jacket being coupled to the corresponding acceleration nozzle via extending webs which delimit openings for a passage of a gas flow to the corresponding acceleration nozzle and wherein the gas nozzle part comprises a plate at the spacing relative to the spinneret part with openings for a reception of the acceleration nozzles.

12. Spinning device according to claim 11, wherein the plate includes openings for a sealed reception of the acceleration nozzles.

13. Spinning device according to claim 11, wherein the spinneret part has a plurality of rows of the spinnerets, and the spinnerets of one row are offset relative to those of the adjacent row.

14. Spinning device according to claim 11, wherein the spinneret and the acceleration nozzle are rigidly connected to each other such that the center of the spinneret is positioned to the center of the acceleration nozzle.

* * * * *